US008795001B1

(12) United States Patent
Lam et al.

(10) Patent No.: US 8,795,001 B1
(45) Date of Patent: Aug. 5, 2014

(54) CONNECTOR FOR PROVIDING PASS-THROUGH POWER

(75) Inventors: Mandy Hin Lam, Fremont, CA (US); Pirooz Tooyserkani, Saratoga, CA (US); Jonathan L. Smith, San Jose, CA (US)

(73) Assignee: Cisco Technology, Inc., San Jose, CA (US)

( * ) Notice: Subject to any disclaimer, the term of this patent is extended or adjusted under 35 U.S.C. 154(b) by 48 days.

(21) Appl. No.: 13/572,253

(22) Filed: Aug. 10, 2012

(51) Int. Cl.
*H01R 13/68* (2011.01)

(52) U.S. Cl.
USPC ..... 439/636

(58) Field of Classification Search
USPC ..... 439/636, 676, 845, 856, 64
See application file for complete search history.

(56) References Cited

U.S. PATENT DOCUMENTS

| | | | | |
|---|---|---|---|---|
| 5,030,108 | A * | 7/1991 | Babow et al. | 439/64 |
| 5,086,372 | A * | 2/1992 | Bennett et al. | 361/802 |
| D372,220 | S * | 7/1996 | Matthews | D13/133 |
| 5,949,656 | A * | 9/1999 | Pinault | 361/788 |
| 6,089,877 | A * | 7/2000 | Seidel | 439/79 |
| 6,089,929 | A * | 7/2000 | Sloey | 439/845 |
| 6,285,546 | B1 * | 9/2001 | Watarai et al. | 361/695 |
| 6,383,039 | B1 * | 5/2002 | Yoneyama et al. | 439/856 |
| 6,705,902 | B1 * | 3/2004 | Yi et al. | 439/678 |
| 7,121,859 | B2 * | 10/2006 | Van Schuylenbergh et al. | 439/260 |
| 7,277,296 | B2 * | 10/2007 | Ice | 361/756 |
| 7,324,335 | B2 * | 1/2008 | Sueyoshi | 361/679.33 |
| 7,839,653 | B2 * | 11/2010 | Koga et al. | 361/788 |
| 8,257,102 | B2 * | 9/2012 | Delgado et al. | 439/247 |
| 2005/0277336 | A1 * | 12/2005 | Yang | 439/636 |

OTHER PUBLICATIONS

Cisco Systems, Inc., "Chapter 1: Installing Line Cards in the Cisco ASR 9000 Series Router," of the "Cisco ASR 9000 Series Aggregation Services Router Ethernet Line Card Installation Guide," May 2012, 96 pages; http://www.cisco.com/en/US/docs/routers/asr9000/hardware/ethernet_line_card/installation/guide/asr9kELCIGinstalling.html.

* cited by examiner

*Primary Examiner* — Alexander Gilman
(74) *Attorney, Agent, or Firm* — Patent Capital Group

(57) ABSTRACT

A pass-through connector is provided in one example and includes a first groove to be coupled to a power supply bus bar; a second groove to be coupled to a power return bus bar; and a plurality of electrical pins disposed on a surface of the connector and configured for interfacing with a circuit board, which is coupled to a line card power connector that is configured to receive a line card.

20 Claims, 9 Drawing Sheets

CONNECTOR FOR PROVIDING PASS-THROUGH POWER

TECHNICAL FIELD

This disclosure relates in general to the field of power and, more particularly, to a connector for providing pass-through power in an electronic environment.

BACKGROUND

Electronic systems continue to grow in terms of sophistication and complexity. One important issue that surfaces in these environments is how to optimize connections that facilitate power between electrical components. In addition, it should be noted that the individual connections should offer an ideal tradeoff between offering a small footprint and providing a highest possible power density. In addition, system reliability should not be sacrificed in any such circuit board layouts. Furthermore, manufacturability concerns should be accounted for when developing any possible connector design. As power requirements continue to evolve to higher levels, such power connectors become more significant in their corresponding architectures.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

DETAILED DESCRIPTION OF EXAMPLE EMBODIMENTS

Overview

A pass-through connector is provided in one example and includes a first groove to be coupled to a power supply bus bar; a second groove to be coupled to a power return bus bar; and a plurality of electrical pins disposed on a surface of the connector and configured for interfacing with a circuit board, which is coupled to a line card power connector that is configured to receive a line card.

In more particular embodiments, the pass-through connector can mate with the line card connector through shared power contact vias. In addition, the pass-through connector can provide a direct connection between the power supply bus bar and the power return bus bar, and the line card power connector. In more implementations, the first and second grooves include an electrical contact for interfacing with bus bar copper plates. The pass-through connector can be a modular pluggable power connector for example.

Other example embodiments may include a particular line card power connector being associated with a particular line card and having its own feed through a particular pass-through connector that is on an opposite side of the circuit board and that can mate to the power supply bus bar and the power return bus bar.

The pass-through connector can be part of a circuit board layout associated with multiple pass-through connectors. The circuit board layout can include a direct pass-through power modular port adapter (MPA) connector footprint. The pass-through connector can provide a direct connection between the power supply bus bar and the power return bus bar, and the line card power connector through the backplane and midplane layers. The pass-through connector can be part of a chassis that includes a plurality of line cards.

Example Embodiments

Figure 1:
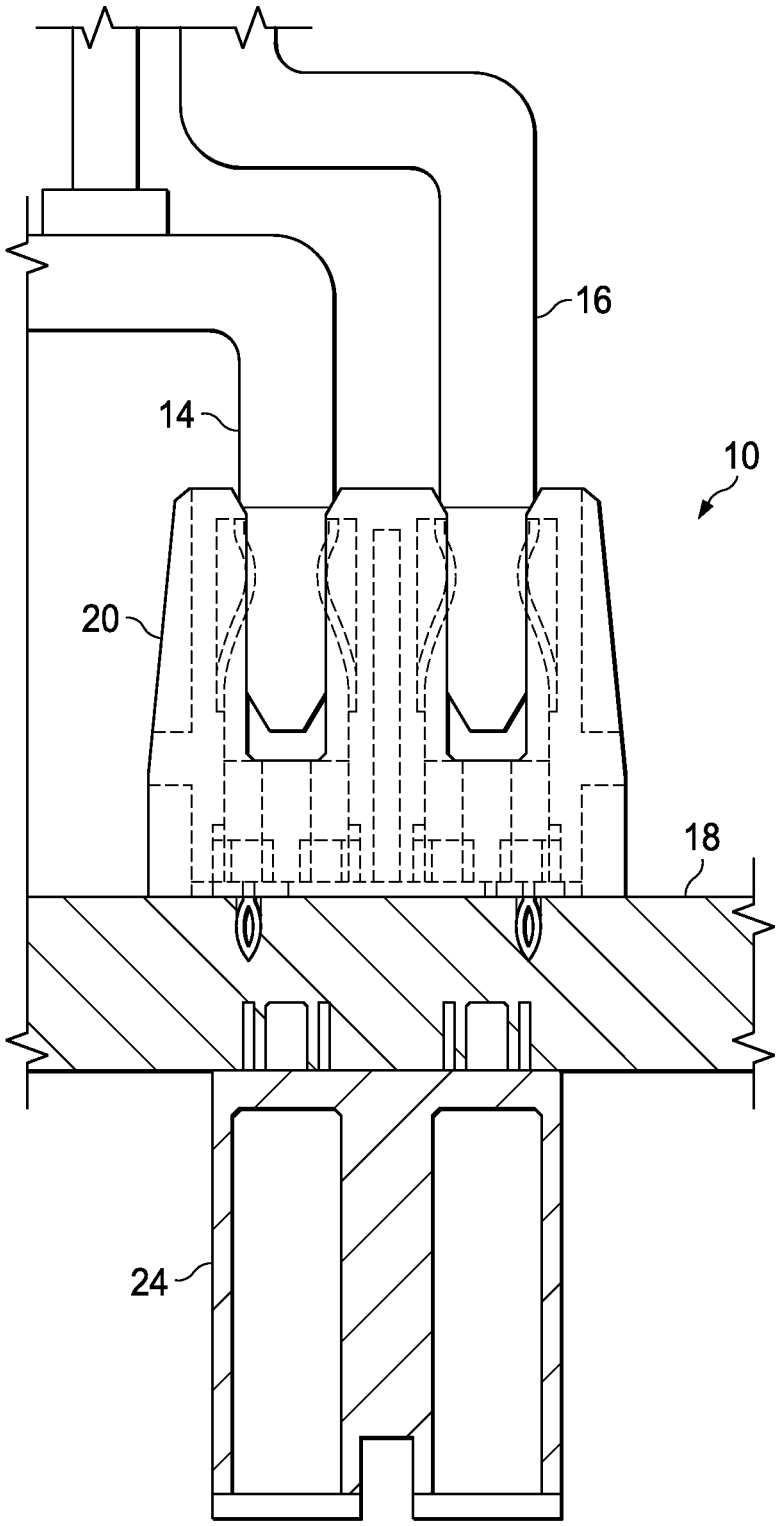
FIG. 1 is a simplified schematic diagram of an example embodiment of a pass-through connector in a line card environment.

Referring now to FIG. 1, FIG. 1 is a simplified schematic diagram of an embodiment of a pass-through power connector 20 that may be used, for example, in conjunction with one or more line cards. FIG. 1 includes several bus bars 14, 16, which can provide a suitable power supply and power return for this particular architecture. Additionally, FIG. 1 includes a circuit board 18 that can receive one or more pins from pass-through power connector 20. FIG. 1 also includes a line card power connector 24 that is coupled to circuit board 18. In a particular implementation, line card power connector 24 is a modular pluggable power connector. Note that a plurality of line cards may be accommodated by the architecture of FIG. 1. In general terms, a line card (or digital line card) is a modular electronic circuit on a circuit board that can interface with various types of network equipment (e.g., interface with a telecommunications access network).

Before turning to specific details associated with the present disclosure, it is important to understand the environment in which pass-through power connector 20 would operate. Such foundational information is offered earnestly for purposes of teaching only and, therefore, should not be construed in any way to limit the broad applications of the present disclosure. In many current systems, power distribution via a bus bar requires screw mounting and/or socket type connectors. A large copper pad with power vias in the backplane/midplane is generally used to connect the power into backplane/midplane layers (e.g., through a detailed power plane design, specification, etc.). In addition, a precise torque is used to provide secure and reliable electrical conductivity between the bus bar and midplane. In order to conduct the power from the bus bar to the line card modules, power would propagate through the bus bar, contact pins, copper pad with power vias, and midplane power planes to complete the circuit.

Note that when securing the bus bar by tightening screws to the backplane/midplane, several problems can arise. For example, when over-tightening the screws, the internal layers of the circuit board can be damaged. Additionally, when under-tightening the screws, the electrical performance of the bus bar is lower, as the resistance value naturally increases. Also, a larger power copper pad or separate connector footprint is commonly required to conduct a high amount of current. Separately, screws may be loosened during product transportation (e.g., due to handling, jarring, shock, vibration, etc.). In addition, workmanship can negatively impact the system's power performance.

Note that any design for a power connector should provide the smallest footprint within the architecture layout, while offering the highest power density for the system. Additionally, another objective in such designs could be to provide a more direct power connection from the bus bar to the line card connectors (e.g., through the midplanes). Additionally, it is important to minimize the power plane requirement in the high-power density layout.

Embodiments of the present disclosure can provide an improved power connector that offers a direct connection between the bus bar and a line card power module, through the backplane/midplane layers. Pass-through power connector 20 can offer pass through power by means of shared vias to a line card. Such a design can eliminate the requirement associated with tightening the screws to provide secure and sound electrical contact between the bus bar and the backplane/midplane layers. In addition, the pass-through compliant pin design offers the smallest footprint in the board layout, while comporting to minimal power planes requirements.

Certain embodiments of pass-through power connector 20 can improve the system reliability with a direct power delivery. It can also improve the manufacturability process by offering a consistent press-fit assembly framework. Moreover, pass-through power connector 20 may eliminate the need for screws to secure the bus bar and for conducting power.

In operation, pass-through power connector 20 suitably provides power to associated line cards that are provisioned in a chassis. Power can be provided to a shared via with the line card power connector. Each connector on the line card can have its own feed through the connector on the opposite side (of the circuit board), which mates to the bus bar. A direct connection is established between the bus bar and pass-through power connector 20, which then suitably mates to the line card connector through shared vias.

Figure 2A:
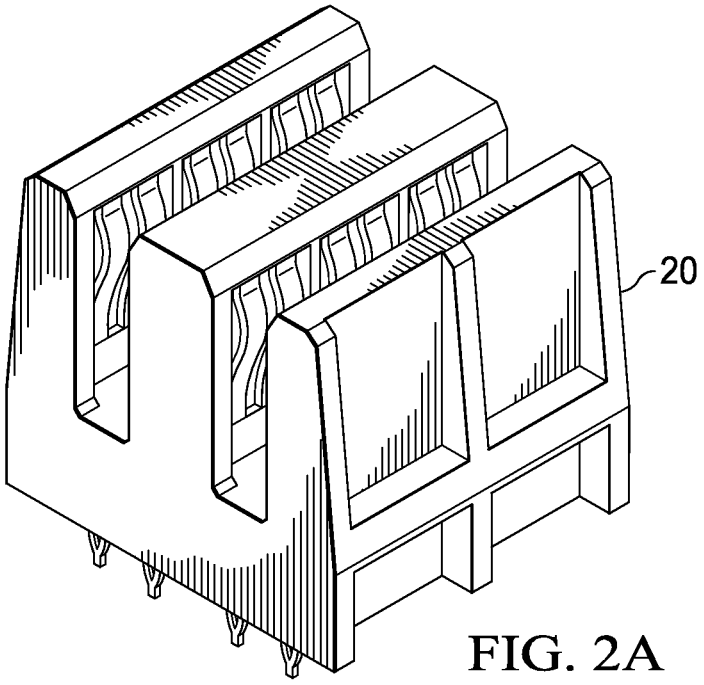
FIGS. 2A-2B are simplified schematic diagrams illustrating perspective views associated with the pass-through connector.
Figure 2B:
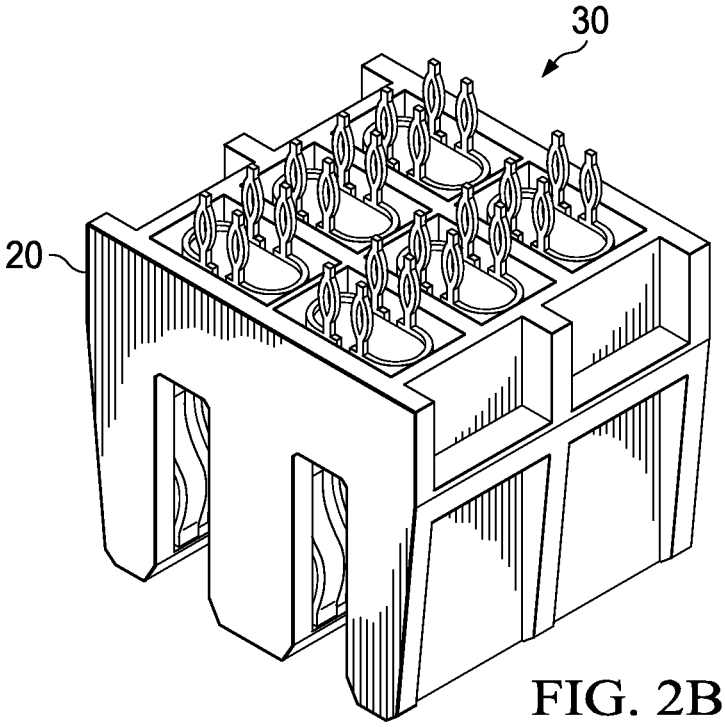

Turning to FIGS. 2A-2B, FIGS. 2A-2B are simplified schematic diagrams illustrating an example implementation of pass-through power connector 20. These FIGURES illustrate several grooves in which bus bar copper plates can be contacted through a suitable connection interface. Note that any other suitable material can be used in place of copper, as the present disclosure is not limited to any particular alloy for establishing electrical contact with other components. FIG. 2B illustrates a plurality of pins that can be plugged into circuit board 18 (as shown in FIG. 1, where two pins are being depicted).

In a particular example, pass-through power connector 20 is a standalone connector having a certain power capacity (e.g., 36 Amperes). Other power capacities can certainly be accommodated by the present disclosure. This particular design of pass-through power connector 20 can improve board layout density, optimize the limited spatial area of the architecture, enhance system power reliability, and reduce downtimes for associated systems during installation activities, assembly processes, repair operations, provisioning more generally, etc. Some of these assembly processes are described below with reference to FIGS. 5-7.

Figure 3:
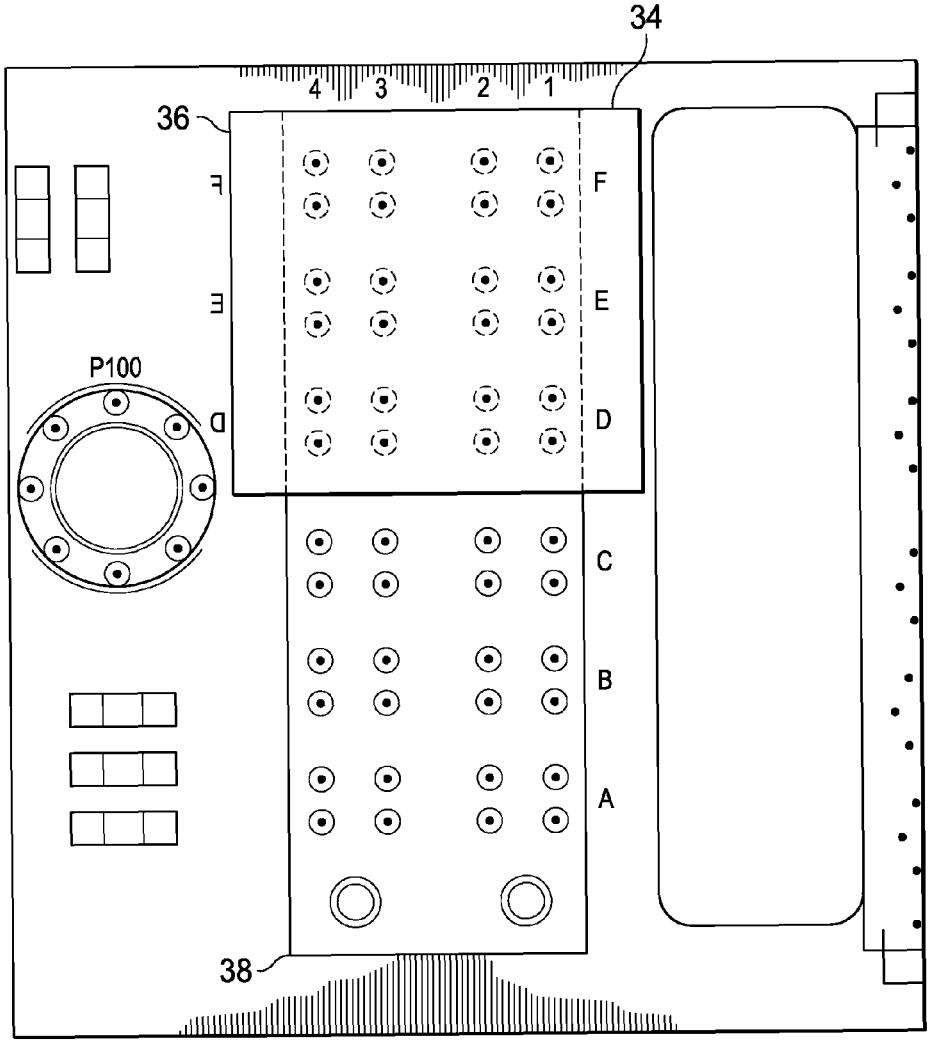
FIG. 3 is simplified circuit board layout illustrating potential connections associated with the pass-through connector.
Figure 4:
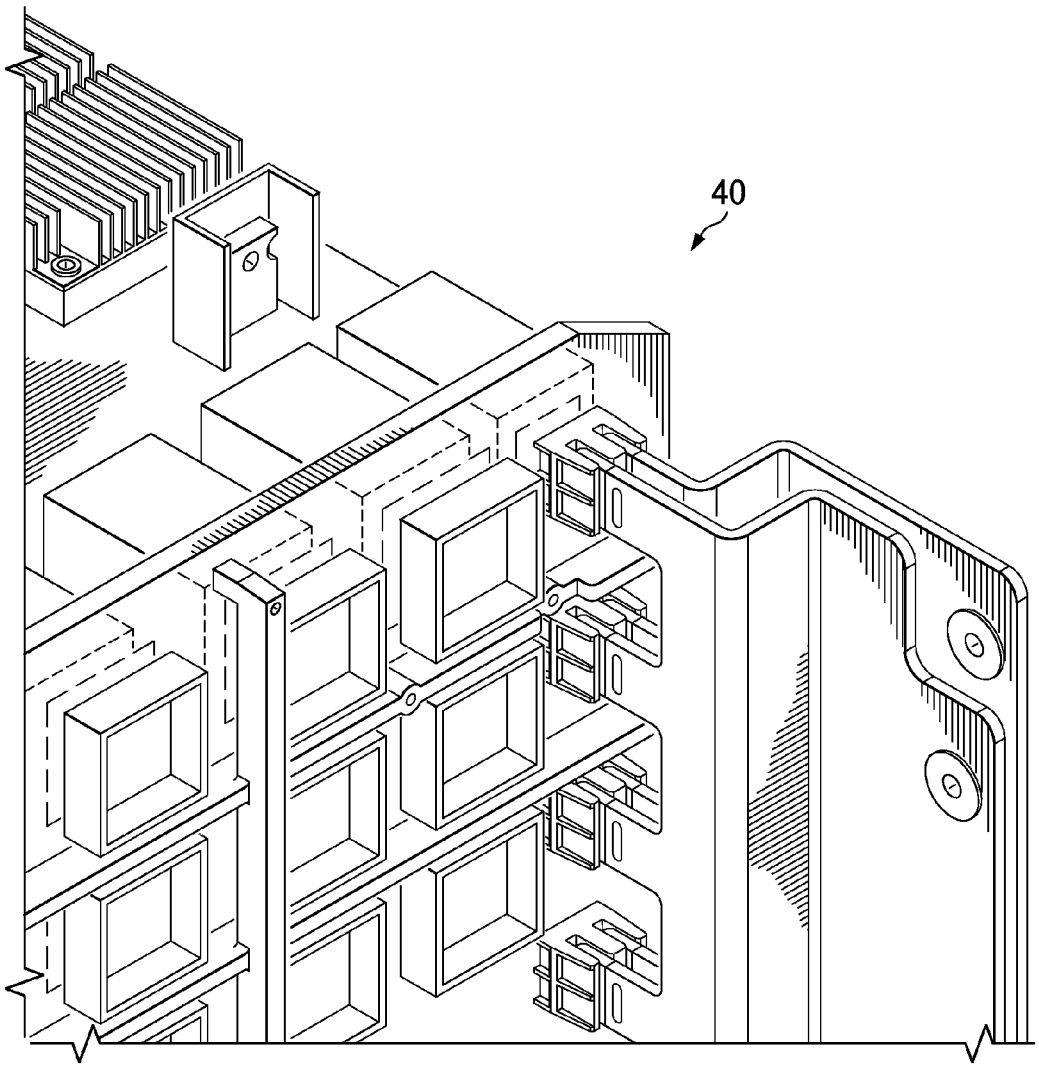
FIG. 4 is a simplified schematic diagram illustrating an example assembly associated with the pass-through connector.

FIG. 3 is a simplified board layout associated with multiple connectors that may be included in the architecture of the present disclosure. This particular board layout includes shared vias 34 and a direct pass-through power modular port adapter (MPA) connector footprint 36. In addition, FIG. 3 includes a line card modular pluggable power connector footprint 38. FIG. 4 is a simplified isometric view 40 of pass-through power connector 20, along with the MPA and line card assembly.

It is imperative to note that although the embodiments illustrated in the FIGURES discussed herein are being illustrated in various configurations, placements, and shapes, the components can be of any suitable size, shape, dimension, placement, etc. For example, the shape of pass-through power connector 20 can have multiple grooves, deeper grooves, provided with more pins, or shaped as an oval, a square, a rectangular, a triangle, or any other suitable shape. In addition, such designs may be provided with rounded corners, made of plastic, composites, or any type of alloy. Considerable flexibility is accommodated by the teachings of the present disclosure. Similarly, pass-through power connector 20 can have different electrical configurations for conducting electrical current for an associated system.

Figure 5:
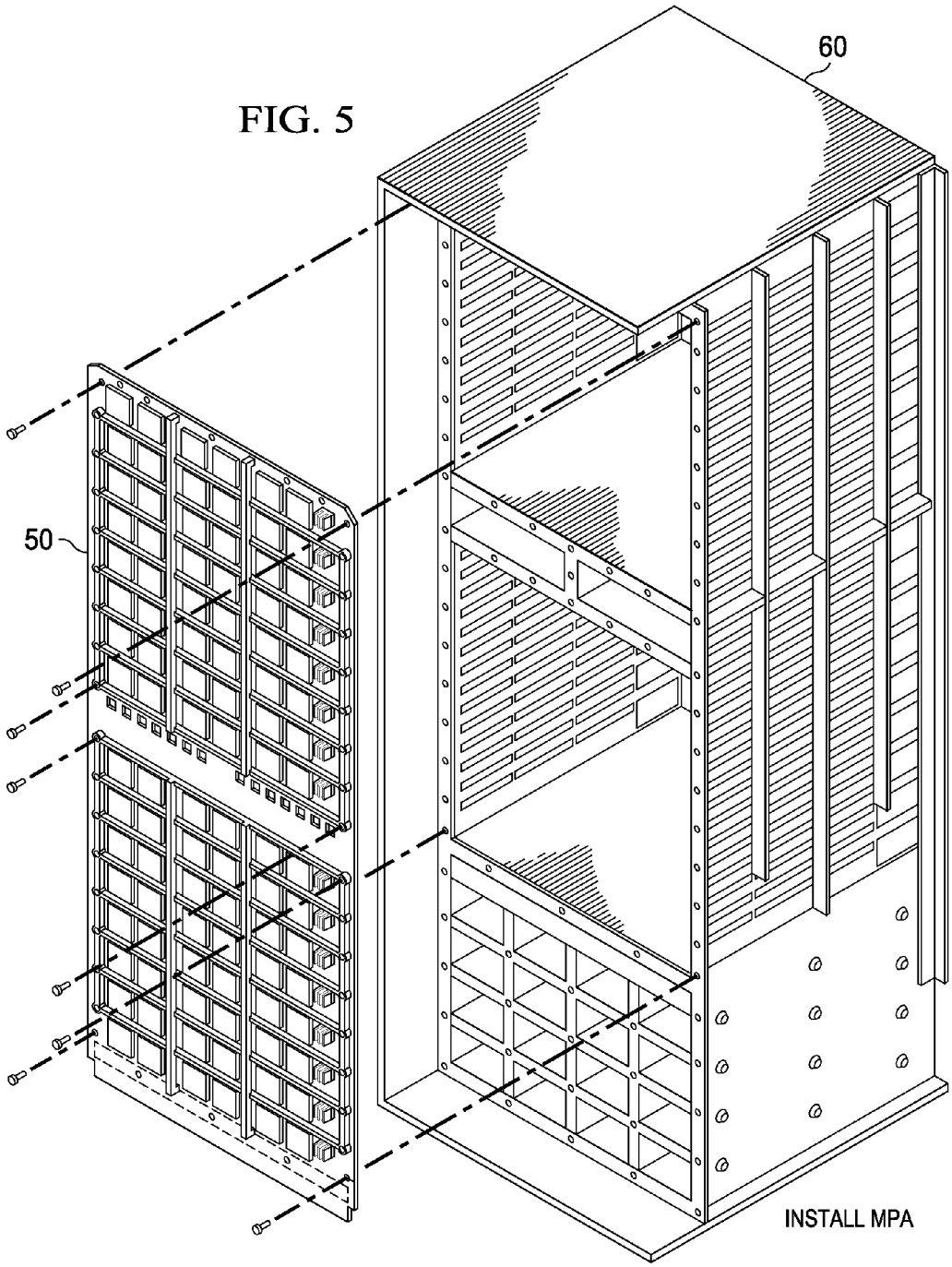
FIGS. 5-7 are simplified schematic diagrams illustrating the potential assembly process associated with the pass-through connector.
Figure 6:
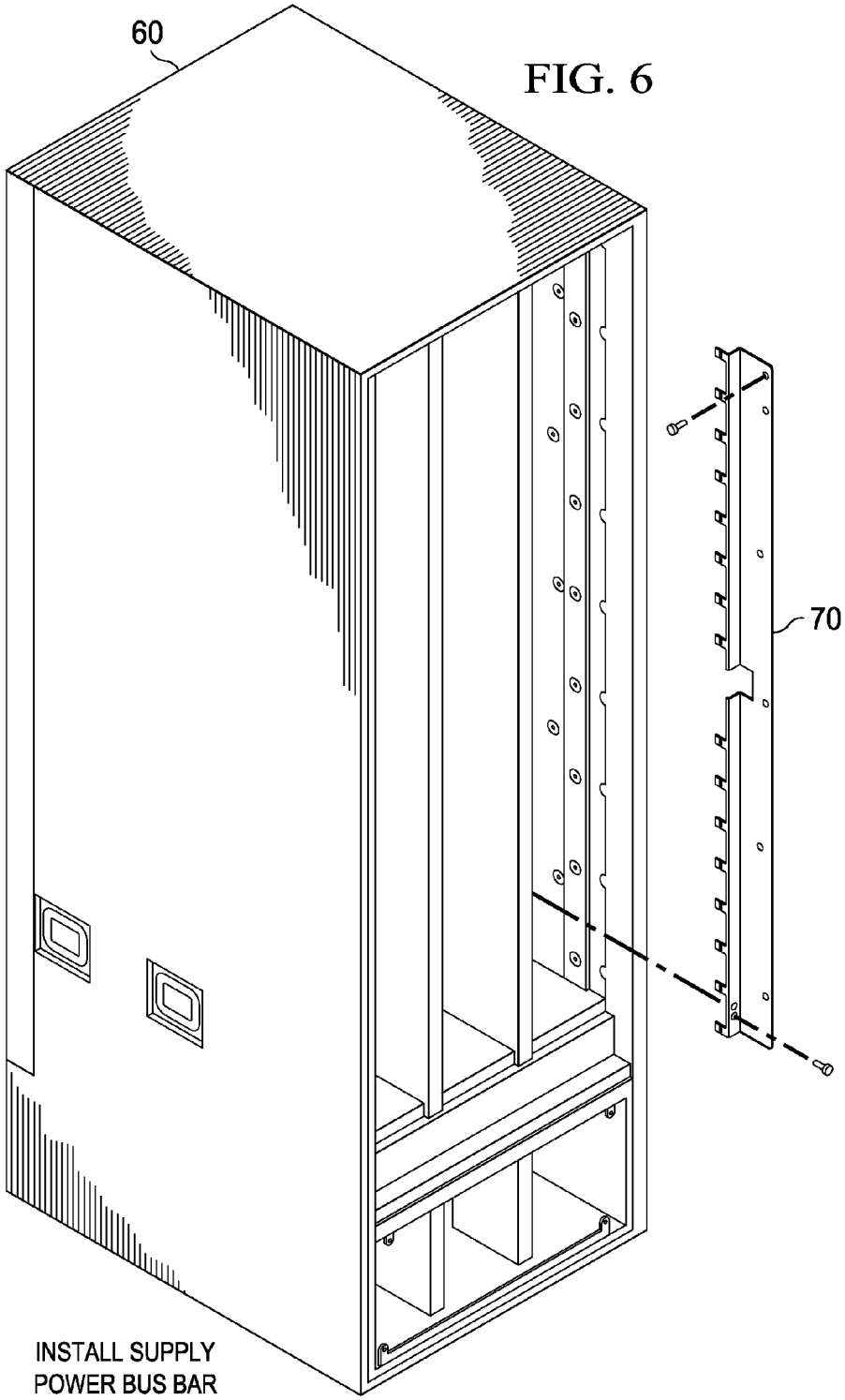
Figure 7:
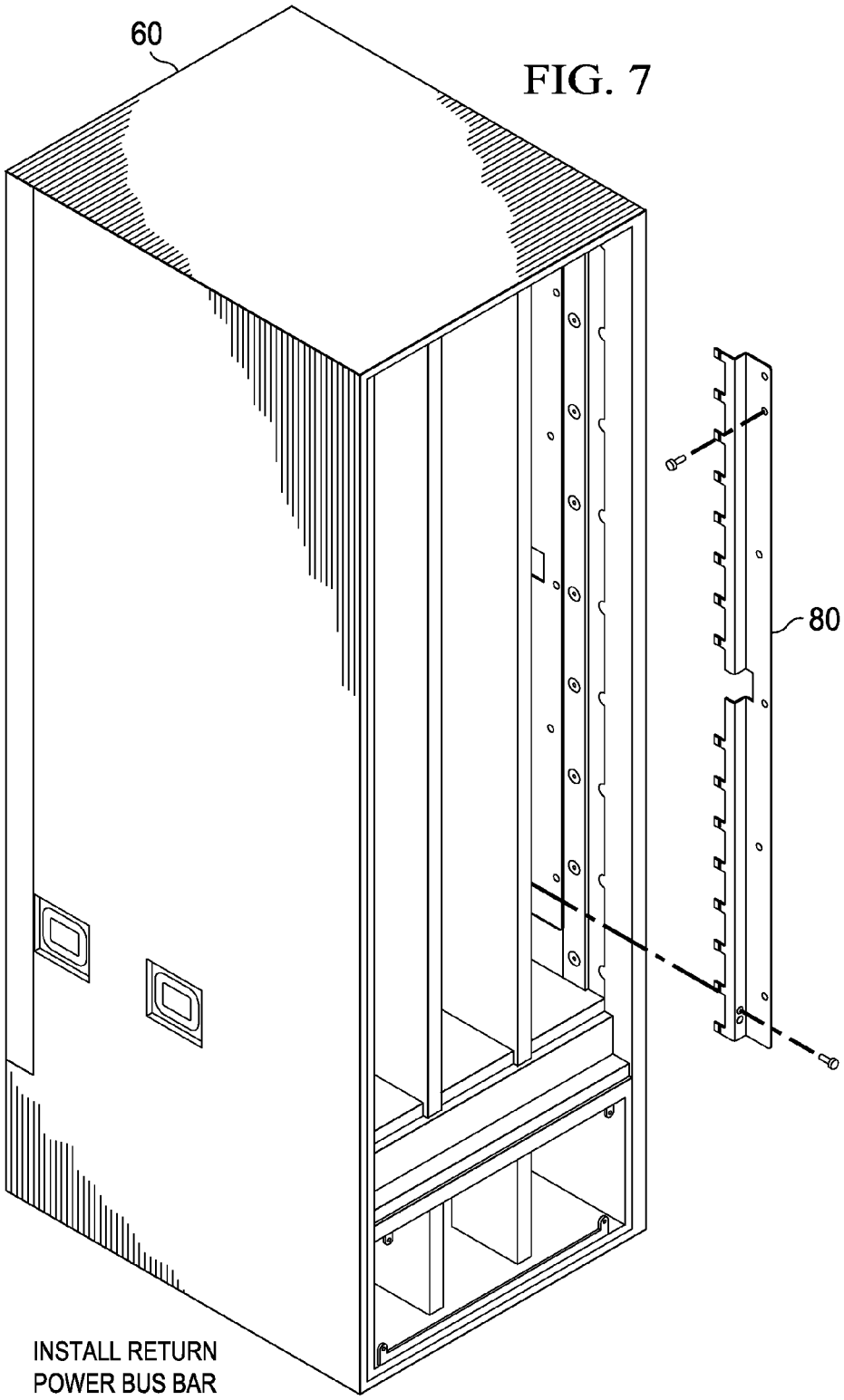

Turning to FIGS. 5-7, these FIGURES illustrate an example chassis assembly process associated with one example embodiment. In FIG. 5, an MPA 50 is installed into a chassis 60. In general, each MPA circuit board is mounted on a metal carrier, and it is sensitive to electrostatic discharge (ESD) damage. During installation, the MPA should be handled by the carrier edges and accompanying handle. Contact with the MPA components or connector pins should be avoided. When a bay is not in use, a blank router MPA slot filler can fill the empty bay to allow the router or switch to conform to electromagnetic interference (EMI) emissions requirements and, further, to allow proper airflow across any of the installed modules. In FIG. 6, a power supply bus bar 70 is installed into chassis 60. In FIG. 7, a power return bus bar 80 is installed into chassis 60.

Figure 8:
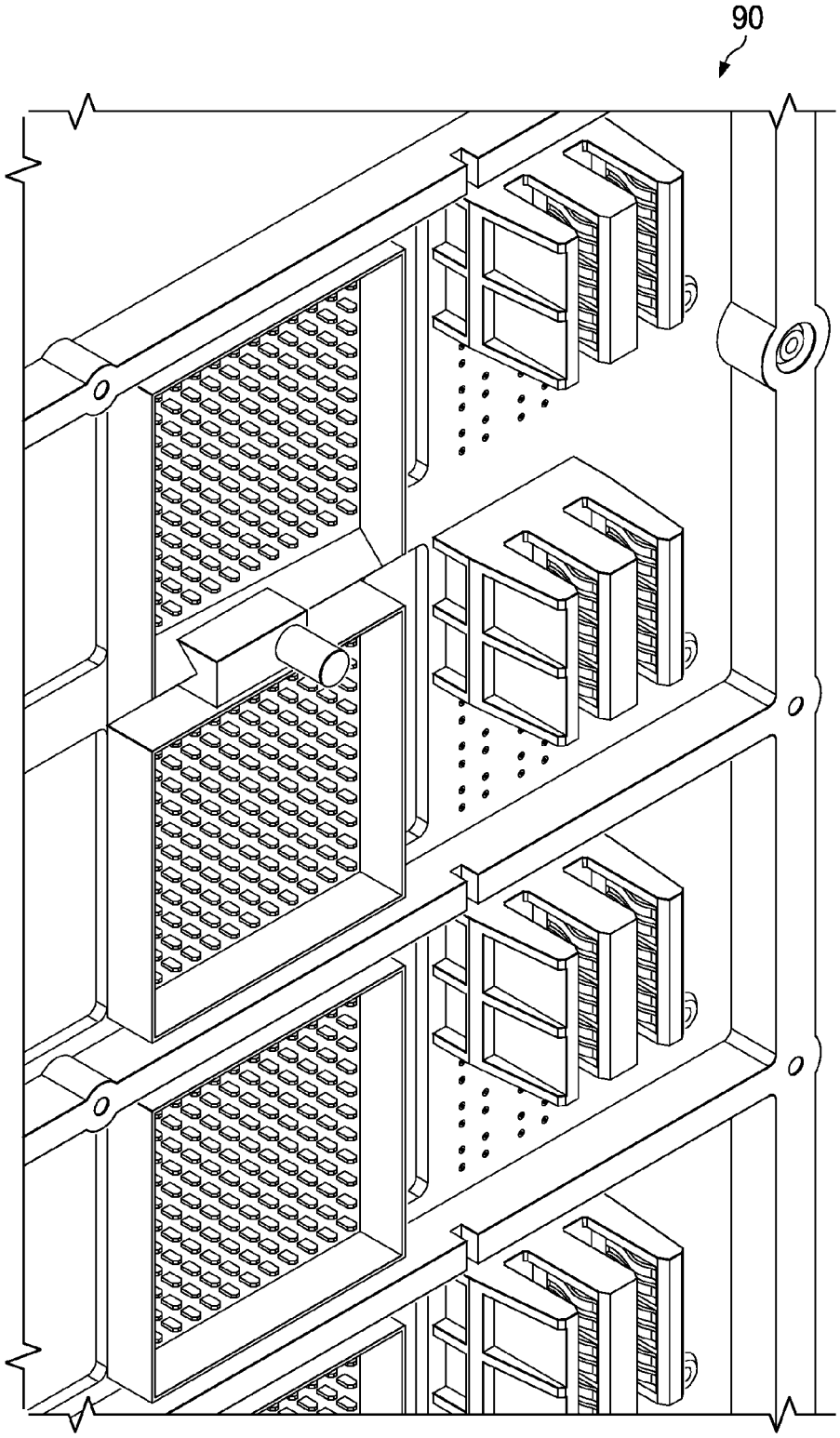
FIG. 8 is a simplified schematic diagram illustrating an example implementation associated with the present disclosure.

Turning to FIG. 8, FIG. 8 is a simplified schematic diagram illustrating a potential embodiment associated with present disclosure. In this particular example, a chassis 90 is being illustrated in a completed form. Note that multiple power pass-through connectors have been successfully provisioned into chassis 90, as is being depicted. In operation, and in the context of an online insertion and removal process, the router modular line cards (MLCs) and modular port adapters can support online insertion and removal (OIR). MPAs can be inserted or removed independently from the modular line card. OIR of a modular line card with installed MPAs can also be supported.

For a managed online insertion and removal of MPAs, the following steps can be performed. First, shut down the MPA with the appropriate shutdown command. Second, confirm that the light emitting diodes (LEDs) have gone from green to the off position. Third, execute commands to verify that the MPA to be removed is in the disabled state. Physically remove the MPA to be replaced and physically insert the replacement MPA. Next, return the MPA to the up state with the appropriate command.

To remove and install an MPA in an MLC, the following steps can be performed. First, insert the MPA in the MLC, locate the guide rails inside the MLC that hold the MPA in place. They can generally be found at the top-left and top-right of the MPA slot and may be recessed (e.g., about an inch in length). Second, carefully slide the MPA into the MLC until the MPA is firmly seated in the MPA interface connector. When fully seated, the MPA might be slightly behind the MLC faceplate. The MPA can slide easily into the slot if it is properly aligned on the tracks. If the MPA does not slide easily, remove the MPA and reposition it, paying close attention to engaging it on the tracks. The reverse operations can be performed in order to remove the MPA.

It is imperative to note that all of the specifications, dimensions, and relationships outlined herein (e.g., height, width, length, materials, etc.) have only been offered for purposes of example and teaching only. Each of these data may be varied considerably without departing from the spirit of the present disclosure, or the scope of the appended claims. The specifications apply only to one non-limiting example and, accordingly, they should be construed as such. In the foregoing description, example embodiments have been described. Various modifications and changes may be made to such embodiments without departing from the scope of the appended claims. The description and drawings are, accordingly, to be regarded in an illustrative rather than a restrictive sense.

Note that with the example provided above, as well as numerous other examples provided herein, interaction may be described in terms of two, three, or four connectors, line cards, etc. However, this has been done for purposes of clarity and example only. In certain cases, it may be easier to describe one or more of the functionalities of a given set of operations by only referencing a limited number of components. It should be appreciated that the present system (and its teachings) are readily scalable and can accommodate a large number of components, as well as more complicated/sophisticated arrangements and configurations. Accordingly, the examples provided should not limit the scope or inhibit the broad teachings of the present disclosure, as potentially applied to a myriad of other architectures.

It is also important to note that the steps in the preceding flows and operational activities illustrate only some of the possible scenarios and patterns that may be executed by, or within, embodiments of the present disclosure. Some of these steps may be deleted or removed where appropriate, or these steps may be modified or changed considerably without departing from the scope of the present disclosure. In addition, a number of these operations have been described as being executed concurrently with, or in parallel to, one or more additional operations. However, the timing of these operations may be altered considerably. The preceding operational flows have been offered for purposes of example and discussion. Substantial flexibility is provided by pass-through connector 20 in that any suitable arrangements, chronologies, configurations, and contact mechanisms may be provided without departing from the teachings of the present disclosure.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

What is claimed is:

1. A pass-through connector, comprising:

a first groove including pairs of contact strips on groove sides to be coupled to a power supply bus bar;

a second groove including pairs of contact strips on groove sides to be coupled to a power return bus bar; and a plurality of electrical pins protruding axially from a surface of the connector, wherein a connection of each pair of the strips to the respective pins forms a half-ring.

2. The pass-through connector of claim 1, wherein the pairs of contact strips of the first groove and the pairs of contact strips of the second groove interface with bus bar copper plates.

3. The pass-through connector of claim 1, wherein the pass-through connector is a modular pluggable power connector.

4. The pass-through connector of claim 1, wherein the plurality of electrical pins interface with a circuit board coupled to a line card power connector that receives a line card.

5. A chassis, comprising:

a pass-through connector including a first groove including pairs of contact strips on groove sides to be coupled to a power supply bus bar, a second groove including pairs of contact strips on groove sides to be coupled to a power return bus bar, and a plurality of electrical pins protruding axially from a surface of the connector, wherein a connection of each pair of the strips to the respective pins forms a half-ring;

a circuit board that interfaces with the plurality of electrical pins; and a line card power connector that couples to the circuit board and receives a line card.

6. The chassis of claim 5, wherein the pass-through connector mates with the line card power connector through shared power contact vias of the circuit board.

7. The chassis of claim 5, wherein the pass-through connector provides a direct connection between the power supply bus bar and the power return bus bar, and the line card power connector.

8. The chassis of claim 5, wherein the line card power connector has a feed through the pass-through connector that is on an opposite side of the circuit board and that mates to the power supply bus bar and the power return bus bar.

9. The chassis of claim 5, wherein the circuit board has a layout associated with multiple pass-through connectors.

10. The chassis of claim 9, wherein the layout includes a direct pass-through power modular port adapter (MPA) connector footprint.

11. The chassis of claim 5, wherein the pass-through connector provides a direct connection between the power supply bus bar and the power return bus bar, and the line card power connector through backplane and midplane layers.

12. The chassis of claim 5, further comprising:

a plurality of line cards.

13. The chassis of claim 5, wherein the pass-through connector offers a press-fit assembly framework.

14. A method, comprising:

interfacing a circuit board with a plurality of electrical pins of a pass-through connector, the pass-through connector including a first groove including pairs of contact strips on groove sides to be coupled to a power supply bus bar, and a second groove including pairs of contact strips on groove sides to be coupled to a power return bus bar, the plurality of electrical pins protruding axially from a surface of the connector, wherein a connection of each pair of the strips to the respective pins forms a half-ring; and coupling the circuit board to a line card power connector that receives a line card.

15. The method of claim 14, wherein the pass-through connector mates with the line card power connector through shared power contact vias of the circuit board.

16. The method of claim 14, wherein the pairs of contact strips of the first groove and the pairs of contact strips of the second groove interface with bus bar copper plates.

17. The method of claim 14, wherein the line card power connector has a feed through the pass-through connector that is on an opposite side of the circuit board and that mates to the power supply bus bar and the power return bus bar.

18. The method of claim 14, wherein the circuit board has a layout that includes a direct pass-through power modular port adapter (MPA) connector footprint.

19. The method of claim 14, wherein the pass-through connector provides a direct connection between the power supply bus bar and the power return bus bar, and the line card power connector through backplane and midplane layers.

20. The method of claim 14, wherein the pass-through connector offers a press-fit assembly framework.

* * * * *